US007989368B2

(12) United States Patent
Patel et al.

(10) Patent No.: US 7,989,368 B2
(45) Date of Patent: Aug. 2, 2011

(54) POLYMER PARTICLES MIXED WITH FIBERS AND PRODUCTS SUCH AS PRESS FABRICS MADE THEREFROM

(75) Inventors: Sanjay Patel, Charleston, SC (US); Robert Crook, Wilson, NC (US)

(73) Assignee: Voith Patent GmbH, Heidenheim (DE)

( * ) Notice: Subject to any disclaimer, the term of this patent is extended or adjusted under 35 U.S.C. 154(b) by 74 days.

(21) Appl. No.: 11/509,013

(22) Filed: Aug. 24, 2006

(65) Prior Publication Data

US 2007/0060001 A1 Mar. 15, 2007

Related U.S. Application Data

(60) Provisional application No. 60/711,585, filed on Aug. 26, 2005.

(51) Int. Cl.
*B32B 27/12* (2006.01)

(52) U.S. Cl. ..... 442/294; 442/59

(58) Field of Classification Search ..... 442/76, 442/104, 164, 268, 270, 271, 275, 277, 278, 442/281, 286, 294
See application file for complete search history.

(56) References Cited

U.S. PATENT DOCUMENTS

| | | | | |
|---|---|---|---|---|
| 4,569,883 | A * | 2/1986 | Renjilian | 442/194 |
| 4,657,806 | A | 4/1987 | Dutt | |
| 4,752,519 | A | 6/1988 | Boyer et al. | |
| 4,798,760 | A | 1/1989 | Diaz-Kotti | |
| 4,946,731 | A * | 8/1990 | Dutt | 428/156 |
| 5,084,326 | A | 1/1992 | Vöhringer | |
| 5,298,124 | A * | 3/1994 | Eklund et al. | 162/306 |
| 5,364,683 | A * | 11/1994 | Flint et al. | 428/141 |
| 5,569,629 | A * | 10/1996 | TenEyck et al. | 501/35 |
| 5,732,749 | A * | 3/1998 | Fargeout | 139/383 AA |
| 6,017,583 | A | 1/2000 | Gass | |
| 6,197,158 | B1 | 3/2001 | Steiner | |
| 6,470,944 | B1 * | 10/2002 | Billings et al. | 156/462 |
| 6,530,854 | B2 * | 3/2003 | Sakuma et al. | 474/237 |
| 6,712,940 | B2 | 3/2004 | Crook | |
| 7,384,517 | B2 * | 6/2008 | Watanabe et al. | 162/358.4 |
| 2004/0154768 | A1 * | 8/2004 | Trokhan et al. | 162/146 |

FOREIGN PATENT DOCUMENTS

| | | |
|---|---|---|
| DE | 197 26 933 | 1/1999 |
| EP | 0 388 601 | 9/1990 |
| EP | 0 786 551 | 7/1997 |
| WO | WO 2004/085727 | 10/2004 |

OTHER PUBLICATIONS

European Examination Report for EP 06 119 445.2 dated Jan. 24, 2007.

* cited by examiner

*Primary Examiner* — Arti Singh-Pandey
(74) *Attorney, Agent, or Firm* — Hershkovitz & Associates, LLC; Abraham Hershkovitz

(57) ABSTRACT

A mixture contains polymer particles along with solids or fibers that can be utilized in press felts (or fabrics) for the press section of a papermaking machine and a method of making the mixtures are described.

10 Claims, 1 Drawing Sheet

POLYMER PARTICLES MIXED WITH FIBERS AND PRODUCTS SUCH AS PRESS FABRICS MADE THEREFROM

CROSS-REFERENCE TO RELATED APPLICATIONS

The present application claims priority to U.S. provisional application 60/711,585, filed on Aug. 26, 2005, the disclosure of which is expressly incorporated by reference herein in its entirety.

BACKGROUND OF THE INVENTION

1. Field of the Invention

This disclosure relates to polymer particles that can be utilized in the preparation of press felts and the like for papermaking processes and, more specifically, in the press section of papermaking machinery. More particularly, this disclosure relates to a dispersion that contains both polymer particles and fibers or other solids and that is utilized in press felts (or fabrics).

2. Discussion of Background Information

Papermaking processes can include the steps of forming the paper fibers into a matted sheet, dewatering the sheet, pressing the matted sheet through rollers to continue the dewatering process and to give the consolidated sheet its desired texture, and further drying the sheet as necessary to remove any remaining excess water from the sheet. Consequently, a papermaking machine generally can include three pertinent sections: the forming section, the press section and the dryer section.

The procedure of papermaking can begin in the forming section with preparation of a pulp slurry. The pulp slurry can be carried through the forming section of the papermaking machine on a forming fabric, not unlike a porous conveyor belt, where the pulp slurry can be formed into a sheet. In the forming section, the sheet can be formed and transported to the press section of the papermaking machine where the process of removing the water from the sheet, begun in the forming section, can be continued.

In the press section of a papermaking machine, the wet, matted sheet of paper fibers can be transported on one or more press fabrics and can be passed through rollers along with the press fabrics such that, in a press nip, at least some of the remaining water can be squeezed out of the sheet and can be absorbed through the permeable press fabric. As compression is increased between the rollers, water removal can be likewise increased. The function of pressing also can consolidate the sheet and provide texture to the surface of the sheet.

Some possible beneficial press felt or fabric properties can include resistance to abrasion, resistance to compaction, heat and chemical resistance as well as strength, permeability and caliper retention.

Within the press section, the sheet can be supported and transported via one or more fabrics referred to as "press felts" (or "press fabrics"). For purposes of this disclosure, the term "press felts" (or "press fabrics") as used herein shall refer to those fabrics that can be used in the press section of a papermaking machine to support and transport the formed sheet of paper fibers to the dryer section of the machine where even more water can be removed.

Press felts can, for example, include a base fabric (for example a woven or non-woven cloth) that can have a staple fiber batt that can be needle punched thereto. In many press felts, multiple layers of batt fibers can be needle punched to the paper side of the base cloth.

The base fabric of press felts can, for example, be made of 100 percent synthetics, primarily nylon polymers, although polyester and other materials can also be utilized.

It will be appreciated that the term "base fabric," as used herein, refers to the underlying substrate of the press felt and can include scrim and composite structures as well as those woven and non-woven fabrics known in the art as being suitable for use in press felts for papermaking machinery. Base fabrics can be, for example, woven or otherwise constructed with cabled monofilaments, plied multifilaments, spun yarns or single monofilaments. Base fabrics can be utilized in a single layer or multilayer mesh, and can be woven as endless belts or woven flat and joined with seams. The weave of the base fabric can be constructed to affect pressure uniformity, flow resistance, void volume and compression properties. These base fabrics can be classified as conventional (endless) designs, stratified (laminated) designs, and seam fabrics. The monofilaments or fibers used therein can be, for example, round in cross-section, flat monofilaments, and hollow monofilaments as the fibers used in the base fabric. Alternatively, for example, the base fabric can be a scrim, e.g., an extruded netting, or a composite structure, e.g., an extruded spun-bonded sheet, both of these types of substrates.

The batt can be made from any suitable material, such as, and for example, from nylon fibers or other similar synthetic materials, which fibers can be, for example, round in cross section.

It will be appreciated that, for the purposes of this disclosure, the term "batt" refers to essentially any kind of assembly or web of fibers other than the base fabric which can be suitable for use in press felts, and is not necessarily limited to conventional batting. The fibers can be carded into a uniform web to form the batt before being needle punched onto the base fabric, for example in a series of layers. Moreover, the batt fibers can be needle punched into the base fabric with the fibers oriented in the cross machine direction or in the machine direction, although alternative methods for needle punching now exist. The needling process can be engineered to affect the density, surface properties and permeability of the press fabric.

Permeable fabrics such as press felts can be prone to surface wear. This can especially be true when the batt structure of the fabric can be stratified and a finer dtex fiber can be utilized on the surface of the fabric to form a fine "cap" layer, with coarser layers of fiber underneath. It can be difficult to needlepunch this fine "cap" layer into the coarse underlay effectively, to be both strong and wear resistant, as well as keeping the fine fiber on the surface in a homogenous layer to provide sheet support, enhance dewatering, make the sheet smoother, etc. Finer dtex fibers can be inherently weak. Resin treatments and low melt binding of fibers can be utilized to reinforce these weak fine diameter surface fibers. However, the presence of these elements can change the openness, porosity, density and flow properties of the surface of the fabric, which can result in negative effects on performance.

Polymer particles added to a fiber network flow through and along such a fiber network. Resin films, networks and coatings have been contemplated to create specific slightly permeable or impermeable surfaces. Such films, networks and coatings generally exhibit lack of void volume and ineffective pore structure for water handling and sheet release. Resultant coatings typically have a porosity that results from the flow and binding of the resin film to the existing fiber network.

WO 2004/085727, the subject matter of which is incorporated herein in its entirety, discloses an industrial fabric comprising a layer of batt fibers optionally needled to a base cloth, whereby during manufacture of the fabric a dispersion of particulate, polymeric material has been applied to the layer of batt of fibers and thermally activated to provide a discontinuous layer containing a mixture of batt fibers and a polymer-bat fibers matrix.

U.S. Pat. No. 6,712,940, which is incorporated herein by reference, is directed to a press felt.

SUMMARY OF THE INVENTION

Aspects of one or more embodiments described in this disclosure can provide a mixture of polymer particles and fibers or other solids that can be utilized in a press fabric (or felt).

At least a first aspect of this disclosure can be directed to a method of applying a polymer coating to a fabric surface, including: one of, obtaining or preparing a suspension including polymer particles and fibers or other solids; then applying the suspension to a fabric surface; and then activating the bonding resin to form a matrix that contains embedded fibers or the other solids.

At least one other aspect of this disclosure is directed to the fibers of the first (or any) aspect being chopped fibers.

A least one other aspect of this disclosure is directed to the fibers or chopped fibers of the first (or any) aspect being constructed of at least one material selected from at least one polyamide, at least one polyester, at least one thermoplastic elastomer, at least one thermoset elastomer, at least one high temperature polymer, at least one aramid polymer, at least one glass fiber material, at least one cellulosic fiber material, at least one ceramic fiber material, at least one organic oxide fiber material, alloys of any of these materials, and mixtures of these materials.

At least one other aspect of this disclosure is directed to the polymer of the first (or any) aspect being at least one polymer selected from at least one thermoplastic polymer, at least one thermoset polymer, at least one polyurethane polymer, and combinations of these polymers.

At least one other aspect of this disclosure is directed to the polymer of the first (or any) aspect being made of particles having a particle size X where X is in a range of approximately 0 microns$\leqq$X$\leqq$500 microns, or alternatively, where X is in a range of approximately 0 microns$\leqq$X$\leqq$200 microns.

At least one other aspect of this disclosure is directed to the embedded fibers of the first (or any) aspect being hollow fibers.

At least one other aspect of this disclosure is directed to the embedded fibers of the first (or any) aspect have a high degree of noncircular shape.

At least one other aspect of this disclosure is directed to the embedded fibers of the first (or any) aspect being softer than the polymer.

At least one other aspect of this disclosure is directed to the embedded fibers of the first (or any) aspect being able to swell significantly during the activating, and then subside, such that pores are created in the polymer caused by a change in fiber dimensions.

At least one other aspect of this disclosure is directed to the suspension of the first (or any) aspect further including carbon fibers to reduce static charges in the fabric.

At least one other aspect of this disclosure is directed to a fabric made by the methods of any of the above-discussed aspects of this disclosure.

At least one other aspect of this disclosure is directed to a press felt made by the methods of any of the above-discussed aspects of this disclosure.

At least another aspect of this disclosure is directed to a papermaking fabric, including a fabric having a coating including a polymer containing embedded chopped fibers, in which the coating has been formed by applying a suspension including a resin and chopped fibers to a surface of the fabric, and then activating the resin to form the polymer.

At least one other aspect of this disclosure is directed to the polymer of the at least another (or any) aspect being at least one polymer selected from at least one thermoplastic polymer, at least one thermoset polymer, and combinations of these polymers.

At least one other aspect of this disclosure is directed to the polymer of the at least another (or any) aspect is made of particles having a particle size X where X is in a range of approximately 0 microns$\leqq$X$\leqq$500 microns, or alternatively, where X is in a range of approximately 0 microns$\leqq$X$\leqq$200 microns.

At least one other aspect of this disclosure is directed to a papermaking fabric, including a fabric having a coating including a polymer containing embedded chopped hollow fibers and carbon fibers; in which the chopped fibers are constructed of at least one material selected from at least one polyamide, at least one polyester, at least one thermoplastic elastomer, at least one thermoset elastomer, at least one high temperature polymer, at least one aramid polymer, at least one glass fiber material, at least one cellulosic fiber material, at least one ceramic fiber material, at least one organic oxide fiber material, alloys of any of these materials, and mixtures of these materials; and in which the polymer is one or more polymers selected from at least one thermoplastic polymer, at least one thermoset polymer, at least one polyurethane polymer and combinations of these polymers; in which the polymer is made of particles having a particle size X where X is in a range of approximately 0 microns$\leqq$X$\leqq$500 microns, or alternatively, where X is in a range of approximately 0 microns$\leqq$X$\leqq$200 microns; and in which the embedded fibers are softer than the polymer and the embedded fibers swell significantly during the activating, and then subside, such that pores are created in the polymer caused by a change in fiber dimensions.

At least one other aspect of this disclosure is directed to a papermaking machine including a papermaking fabric or press felt of at least one of the above aspects.

These together with other aspects that will be subsequently apparent, reside in the details of construction and operation as more fully hereinafter described and claimed.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the aspects of this disclosure only and are presented in the cause of providing what is believed to be the most useful and readily understood description of the principles and conceptual aspects of this disclosure. In this regard, no attempt is made to show structural details of this disclosure in more detail than is necessary for the fundamental understanding of this disclosure, the description taken with the drawings making apparent to those skilled in the art how the several forms of this disclosure may be embodied in practice.

In general, a press felt suitable for use in transporting a sheet of paper fibers through the press section of a papermaking machine can include a base fabric and at least one layer of an assembly of fibers securely attached to the base fabric. In accordance with this disclosure as set forth hereinbelow, the assembly of fibers, i.e., batt, includes a plurality of fibers.

Further aspects of the invention may be provided in a method for making the press felt.

Figure 1:
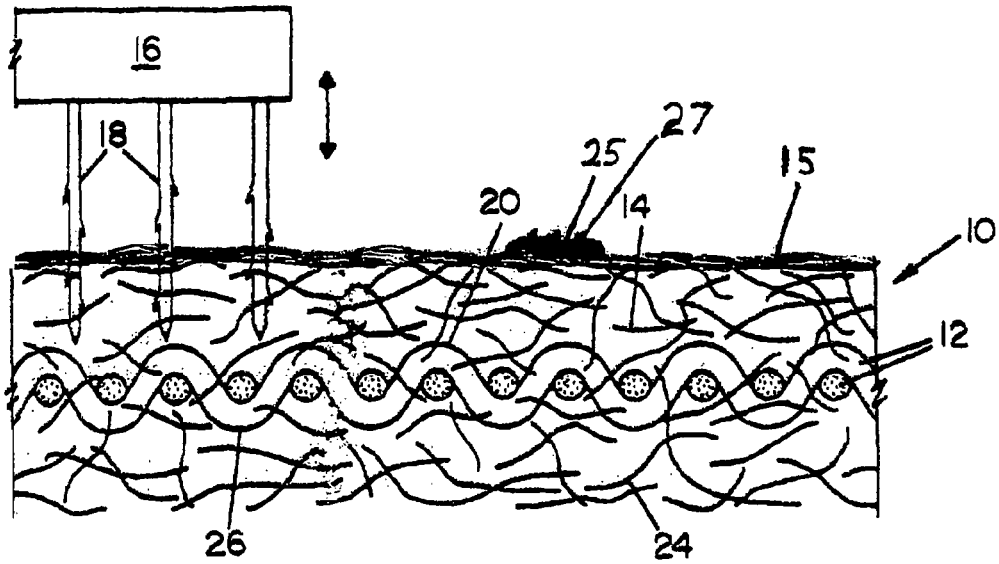
FIG. 1 is directed to a cross-sectional view of a papermaking felt in accordance with the present disclosure.

A cross-sectional view of an exemplary press felt or fabric that can be utilized for transporting a sheet of paper fibers through the press section of a papermaking machine is represented generally by reference numeral 10 in FIG. 1.

The press felt (or fabric) 10 can take various forms of press felts, such as, and for example, batt-on-base felts, baseless felts, batt-on-mesh felts, felts with no-crimp base fabric, composite fabrics, and laminated (stratified) press felts.

Figure 2:
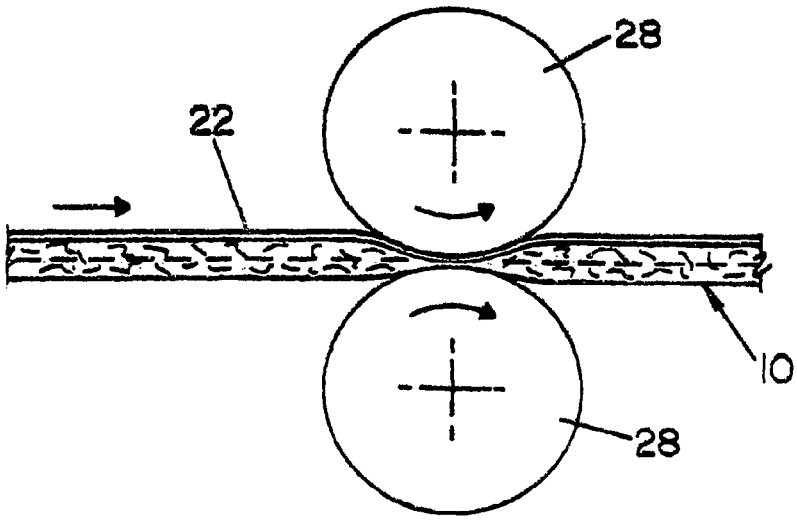
FIG. 2 is directed to a papermaking felt as part of a papermaking machine, in accordance with the present disclosure.

The press fabric 10 can, for example, include a base fabric 12 and one or more layers of an assembly of fibers, such as batt 14, securely attached to the base fabric 12, for example by needle punching utilizing a needle punching apparatus 16. A surface (or "cap layer") 15 can also be securely attached to the base fabric 12 and the batt 14, for example utilizing needle punching. The apparatus 16 is shown with needles 18 for punching the assembly of surface layer 15 and the fibers 14 into the base fabric 12. Where only one layer of fibers 14 is employed, it can be needle punched into the side 20 of the base fabric 12 facing the sheet of paper fiber 22, i.e., the paper side of the base fabric, and can therefore be disposed generally between the base fabric 12 and the surface layer 15. As shown in FIG. 2, a sheet of paper fibers 22 lies adjacent to the surface layer 15 of the press fabric 10.

A second layer 24 of batt fibers can optionally be employed. Such layer 24 can be needle punched into the other side 26 of the base fabric facing or contacting the roller(s) 28 of the papermaking machine, i.e., the machine side (also referred to herein as the "roll side") of the base fabric, or can be needle punched through the paper side (also referred to herein as the "sheet side") of the base fabric to the machine side. Various methods of application (e.g., needle punching) of the assembly of fibers 14 to the base fabric 12 can be utilized to sufficiently and securely attach the assembly of fibers 14 to the base fabric 12. For example, multiple layers of fibers 14 can be needle punched into the base fabric 12.

The base fabric 12 can, for example, be woven (except for no-crimp base fabrics) or formed as a composite and can be made from any of a number of methods. For example, the fabric can be a single layer or multilayer mesh, and can be woven as a endless belt or woven flat and joined later. The base fabric 12 can be woven in a number of alternative manners to manipulate and otherwise provide particular characteristics and properties to the base fabric. For example, the fabric can be stratified or laminated with additional fabrics on its surface to create additional layers, or one or more layers of fabric can be employed.

The base fabric 12 can be constructed from any suitable material. For example, the base fabric can be made of 100 percent synthetics, although wool can alternatively be employed. Polyamide (nylon) polymers can be utilized, but the base fabric can also be constructed of polyester, polyphenylene sulfide, or other similar materials. Nylon can have greater resistance to compaction in the press nip compared to polyester, and can be more abrasion resistant and tougher.

The base fabric 12 can be constructed of any suitable material. For example, the base fabric 12 can be formed of cabled monofilaments, plied multifilaments, spun yarns, and/or single monofilaments. Each type of fiber can have properties that influence operational characteristics of the press felt 12 and can be chosen based upon the particular characteristic desired of the base fabric. For example, multifilaments can be more durable and have higher elongation than monofilaments, but can be more compressible and less resistant to chemical attack.

It will be appreciated that the term "batt" as used herein refers not only to a soft, bulky bundle of fibers forming a layer on the surface of the base fabric, but also to any other type of assembly of fibers, be it woven or nonwoven, carded or not carded, suitable for use in the press section of a papermaking machine.

The batt fibers 14 of the press felt 10 can contain a plurality of fibers, each cut to any suitable length, for example a length of from about 1 inch to about 6 inches, and for example, from about 3 inches to about 4 inches. The fibers forming the bat can be any suitable denier, for example a denier in a range from about 3 denier to about 100 denier, or for example in a range from about 3 denier to about 50 denier, or from about 15 denier to about 25 denier.

The fibers that form the batt can be, for example, nonwoven and made from 100 percent synthetics, for example, nylon, polyester or polyphenylene sulfide. For example, the fibers can be made from a nylon selected from the group consisting of nylon 6, nylon 6,6, nylon 6,10, nylon 6,12, nylon 11, nylon 12, copolymers thereof, and blends thereof.

The fibers can be, for example, coated with a hydrophilic (or alternatively a hydrophobic) finish. The hydrophilic (or hydrophobic) finish may be permanent or non permanent.

The hydrophilic (or hydrophobic) finish can be applied to the fibers during any of a number of different steps of the production process. For example, the finish can be applied in the draw bath given the fibers. For example, the fibers can be first quenched with air and then drawn and textured. As another alternative, the finish can be applied in a stufferbox during a crimping process. The finish can be sprayed onto the fibers at a stufferbox and then sent to an oven where the finish can be cured with steam or hot air. In another alternative, the non-permanent finish can be applied directly to the fibers after they come out of an oven.

Once formed, the fibers can be cut to any suitable length, for example to a length of from about 1 inch to about 6 inches. The fibers can be cut to a single length or at multi-lengths, and can be cut variably (i.e., cut to a different length with each cut) or in unison (i.e., cut a single length first, then a second length, and so on).

The assembly of fibers or batt 14 can be produced by any suitable method. For example, processing can include blending the fibers together and then carding them into a uniform web. The web of fibers may or may not be preneedled together before being applied in a series of layers onto the base fabric 12 to form the batt 14. The web of fibers forming the batt and the base fabric 12 can then be fed through a zone where several thousand barbed needles, such as 18, can be needle punched into the composite to tack the web or assembly of fibers (i.e., batt) to the base fabric. The assembly of fibers can be spliced at the start and stop of web application in the cross machine direction. Some embodiments can apply the web in a spiral method that eliminates cross machine direction oriented splices.

Once the batt fibers have been needle punched onto the base fabrics, a press felt according to the concepts of the present invention is formed. The press felt can then be disposed within the press section of a papermaking machine and utilized to dewater sheets of paper fibers.

The fibers of this disclosure can be suitable for utilization as batt in press felts, but are not necessarily limited thereto. For example, the fibers can alternatively be suitable for use in baseless, non-woven press felts. The press felts can be manufactured with equipment and methods other than what is detailed hereinabove, it being understood that the equipment and methods for producing the press felts, base fabrics and batt, as well as other materials, have been described for purposes of illustration and demonstration only. That is, the description and illustration is shown hereinabove is byway of example, and the scope of the claims below is not limited to the exact details shown or described.

Aspects of this disclosure can utilize a mixture of polymer particles and fibers and are applied onto a fabric substrate surface in order to reduce flow of the polymer away from the applied surface. The result can be excellent adhesion of the polymer to the substrate, which can result in very high abrasion resistance, while the polymer coating does not suffer from degradation during thermoforming.

The polymer coating, such as the coating 25 shown with embedded fibers 27 in FIG. 1, can be applied to the sheet side surface of a PMC fabric, such as a press fabric. The coating 25 is shown only a portion of the surface of the press fabric. However, the coating 25 could be applied over any portion, or the entirety, of the sheet side surface of the press fabric. This can result in the reduction of flow of the polymer, for example a polyurethane, away from the substrate surface, to which the polymer is applied, when heated.

The inclusion of fibers, for example chopped fibers, allows for greater control of the porosity of the resin film with the fabric fibers.

Chopped fibers that have either hollow cores or are so convoluted in shape, so that voids can be created on the surface, even if the surrounding resident network can be essentially continuous. Such fibers can, for example, be EASTMAN® 4DG, deep-grooved polyester fibers.

Chopped fibers can alternatively, for example, be largely flat in shape to also enhance micro pressing uniformity. Additionally, the fibers can also include very soft, easy to deform spandex-type segments.

Chopped fibers can have a smaller diameter than a carded, needled bat, in order to create a smoother, more uniform pressing surface for greater paper sheet dryness and/or topographical uniformity. For example, chopped fibers of 2 denier and, roughly 15 microns or less can be effective.

A fabric can be created having a desired void volume, smoothness, pore structure, and compressibility for various pressing, sheet transfer, or calendaring operations by creating a surface member that can be constructed of a largely continuous resinous component mixed with chopped fibers. For example, the majority component can be the resin, and the minority component can be the chopped fibers.

The embedded chopped fibers can, for example, be hollow, and/or can have with a high degree noncircular shape, and/or can be very soft relative to the resident matrix, or a combination of all three. Fibers can also be selected that can swell significantly during a resin curing process, but that can sequentially subside, such that pores can be created in the resin caused by this change in fiber dimensions. Additionally, carbon fibers can also be added to reduce static charges.

Alternatively, rather than utilizing fibers (or in combination with fibers), relatively large solids that are not exactly "fibers" can be utilized. For example, "chips" of polymeric material that soften and bond to surface and surrounding bonding resin, do some of the bridging and the like that fibers do. These large solids or "chips" for example can be of irregular shape, disc shaped, relatively flat and/or up to approximately 2 mm in diameter.

Exemplary Embodiment

A suspension of a polymer in water can be created and applied to a substrate of suitably fine pore structure, for example, a forming fabric or a needled press felt. The polymer can be, for example, polyurethane. The polyurethane particles can have any suitable predetermined particle size, for example a particle size in the range of approximately $0 \leqq X \leqq 500$ microns, for example in the range of approximately $0 \leqq X \leqq 200$ microns. The particle can be selected, for example, so that the majority of the particles will not pass through a fabric substrate.

The polyurethane can have a relatively low melt point, for example in the range of approximately 50° C. to 250° C., or for example in the range of approximately 150° C. to 250° C., depending on the polymer selected. Added to the suspension is a mix of chopped fibers selected that can enhance the surface properties of the finished fabric. These enhanced surface properties can include addition of void volume, providing pores for water adsorption through pores for water transport, or micro pressure points, which can also be unusually soft and compressible.

The polymer can be any suitable composition, for example a composition selected from: a thermoplastic polymer, a thermoset polymer, and a mixture thereof.

The fibers can have any suitable diameter, for example a diameter in a range of approximately 1 DPF to 50 DPF, or for example a diameter in a range of 1 DPF to 20 DPF, and can be chopped to any suitable length, for example a length of approximately less than or equal to 3 mm.

Alternatively, nano fibers can be added to or substituted for the chopped fibers.

The suspension can be applied to a substrate surface by any suitable method, for example by spraying, for example utilizing a curtain sprayer, or for example utilizing a kiss roller, to spray or roll the suspension onto the substrate surface. A resulting substrate can then be heated, to cure the polymer according to its melting behavior or flow characteristics, at any suitable temperature, for example at a temperature in a range of 50° C. to 250° C. for a suitable heat source exposure duration, for example a duration of approximately 1 minute to 12 hours, or for example approximately 30 minutes to 240 minutes. Curing of the polymer plus fiber causes the polymer to bond with the substrate while the embedded fibers can emerge towards the paper contacting surface of the substrate.

A resultant surface can handle water and still be largely impermeable in total, so that re-wet is minimized. Additionally, the surface of the fabric can transfer a sheet of paper web and still provide an exceptionally high level of smoothness to the paper web and resultant paper sheet.

The chopped fiber can be any suitable composition, for example a composition selected from: polyamides, polyesters, thermoplastic elastomers, thermoset elastomers, high temperature polymers such as aramid types, glass fibers, cellulosic fibers, ceramic fibers, organic oxide fibers, alloys or mixtures of any of the above types of fibers, or any other suitable fiber.

It is noted that the foregoing examples have been provided merely for the purpose of explanation and are in no way to be construed as limiting of this disclosure. While this disclosure has been described with reference to exemplary embodiments, it is understood that the words which have been used herein are words of description and illustration, rather than words of limitation. Changes may be made, within the purview of the appended claims, as presently stated and as amended, without departing from the scope and spirit of this disclosure in its aspects. Although this disclosure has been described herein with reference to particular means, materials and embodiments, this disclosure is not intended to be limited to the particulars disclosed herein; rather, this disclosure extends to all functionally equivalent structures, methods and uses, such as are within the scope of the appended claims.

What is claimed is:

1. A press felt comprising a base fabric, one or more batt layers being securely attached to a paper facing side of the base fabric, and an essentially continuous polymer coating, the essentially continuous polymer coating comprising a polymer, embedded chopped fibers configured to control porosity of the press felt, and pores positioned around the chopped fibers inside the essentially continuous polymer coating, wherein the essentially continuous polymer coating has been formed by applying a suspension comprising polymer particles and the chopped fibers to a surface of the base fabric, and then heating the polymer particles and chopped fibers.

2. The press felt of claim 1, wherein the chopped fibers are at least one of a polyamide, a polyester, a thermoplastic elastomer, a thermoset elastomer, a high temperature polymer, an aramid polymer, a glass fiber material, a cellulosic fiber material, a ceramic fiber material, an organic oxide fiber material, and an alloy of any of these materials.

3. The press felt of claim 1, wherein the polymer particles are at least one of at least one thermoplastic polymer, at least one thermoset polymer and a polyurethane polymer.

4. The press felt of claim 1, wherein the polymer particles have a particle size X where X is in a range of greater than 0 microns and less than 500 microns.

5. The press felt of claim 4, wherein the particle size X is in a range of greater than 0 microns and less than 200 microns.

6. The press felt claim 1, wherein the embedded chopped fibers are softer than the polymer particles and the embedded chopped fibers swell during the heating process, and then subside, such that the pores are created in the essentially continuous polymer coating caused by a change in the embedded chopped fibers' dimensions.

7. The press felt of claim 1, wherein the embedded chopped fibers are hollow fibers.

8. The press felt of claim 1, wherein said chopped fibers are 15 microns or less in diameter.

9. The press felt of claim 1, wherein the embedded chopped fibers are convoluted in shape.

10. The press felt of claim 1, wherein the embedded chopped fibers are nano fibers.

* * * * *